US005522302A

United States Patent [19]

Yuda et al.

[11] Patent Number: 5,522,302

[45] Date of Patent: Jun. 4, 1996

[54] CYLINDER AND PISTON ASSEMBLY AND METHOD OF PORTING

[75] Inventors: Lawrence F. Yuda, Seneca; Lawrence F. Yuda, Jr.; Ricky L. Keaton, both of West Union, all of S.C.

[73] Assignee: Compact Air Products, Inc., Westminster, S.C.

[21] Appl. No.: 250,535

[22] Filed: May 31, 1994

[51] Int. Cl.[6] ..... F15B 11/00; F01B 31/00

[52] U.S. Cl. ..... 91/533; 91/428; 92/163; 92/151

[58] Field of Search ..... 92/163, 164, 169.1, 92/151; 91/508, 533, 428; 29/888.06, DIG. 47, 527.6

[56] References Cited

U.S. PATENT DOCUMENTS

| | | | |
|---|---|---|---|
| 1,031,528 | 7/1912 | Cole | 91/533 |
| 2,085,105 | 6/1937 | Lex | 92/151 X |
| 2,116,046 | 5/1938 | Schmutz | 91/533 X |
| 3,255,675 | 6/1966 | Reeve et al. | 92/151 X |
| 3,485,141 | 12/1969 | Ott et al. | 91/533 |
| 3,554,088 | 1/1971 | Bruyn | 91/533 X |
| 3,718,205 | 2/1973 | Fair et al. | 91/533 X |
| 4,005,598 | 2/1977 | Ehmann et al. | 91/533 X |
| 4,046,167 | 9/1977 | Papp et al. | 92/117 A X |
| 4,243,060 | 1/1981 | McKendrick | 91/428 X |
| 4,590,846 | 5/1986 | Stoll | 92/151 |
| 4,596,267 | 6/1986 | Tosseghini | 92/151 X |
| 4,682,535 | 7/1987 | Stoll | 92/169.1 X |
| 5,241,896 | 9/1993 | Braun et al. | 92/163 X |
| 5,245,912 | 9/1993 | Muller et al. | 92/163 X |

FOREIGN PATENT DOCUMENTS

| | | | |
|---|---|---|---|
| 2004212 | 8/1971 | Germany | 92/151 |

*Primary Examiner*—John E. Ryznic
*Attorney, Agent, or Firm*—Ralph Bailey

[57] ABSTRACT

A multi-piston assembly is illustrated wherein a cylindrical housing (A) is ported through longitudinal circumferentially spaced ports (F) and (G) carried within the cylindrical housing. Porting through piston rods is thus avoided so that their cross section may be reduced thereby increasing the area of the pistons available for contact by pressurized fluid. Even greater force may be made available for actuating a tool by the addition of an add-on unit utilizing complementary longitudinal porting.

11 Claims, 7 Drawing Sheets

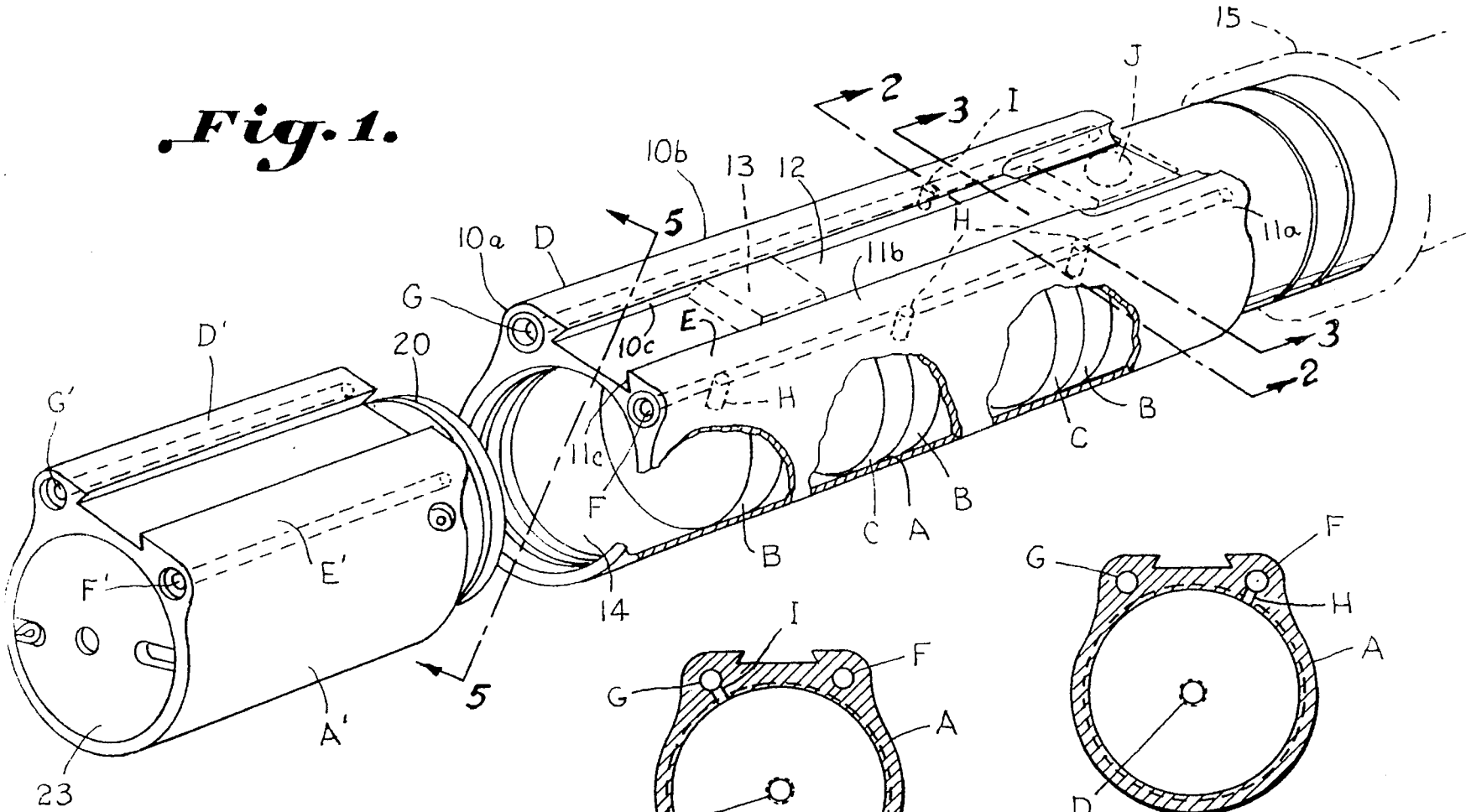
Fig. 1.
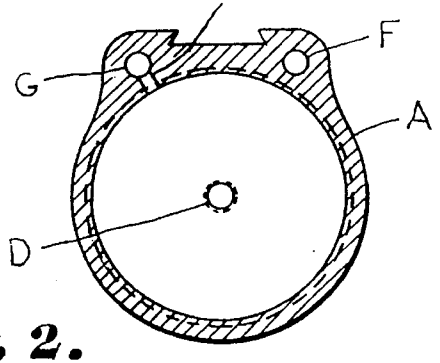
Fig. 2.
Fig. 3.

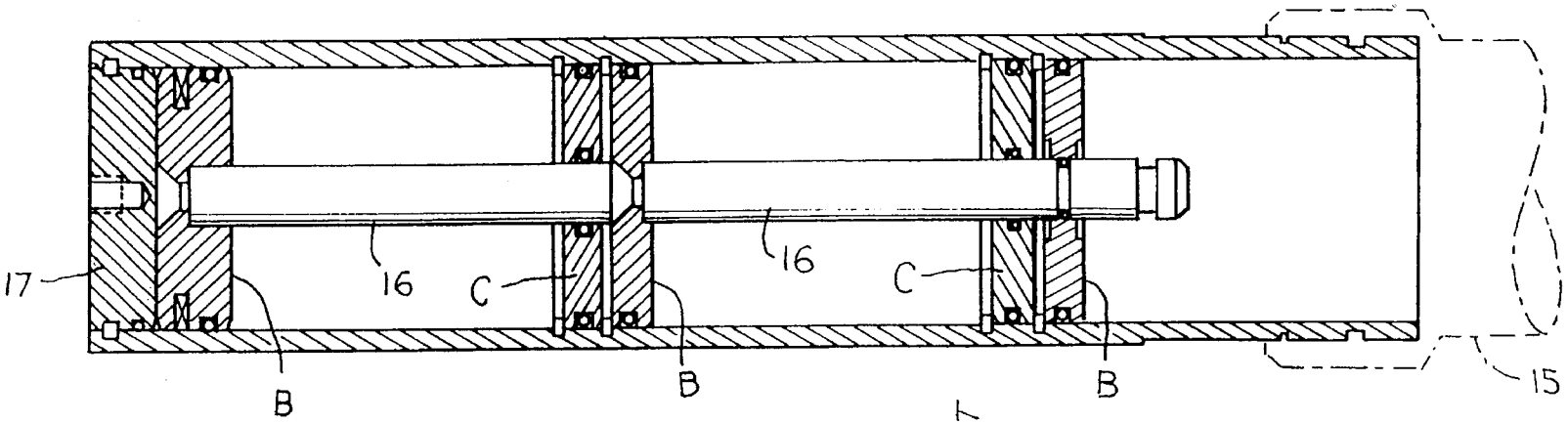
Fig. 5.
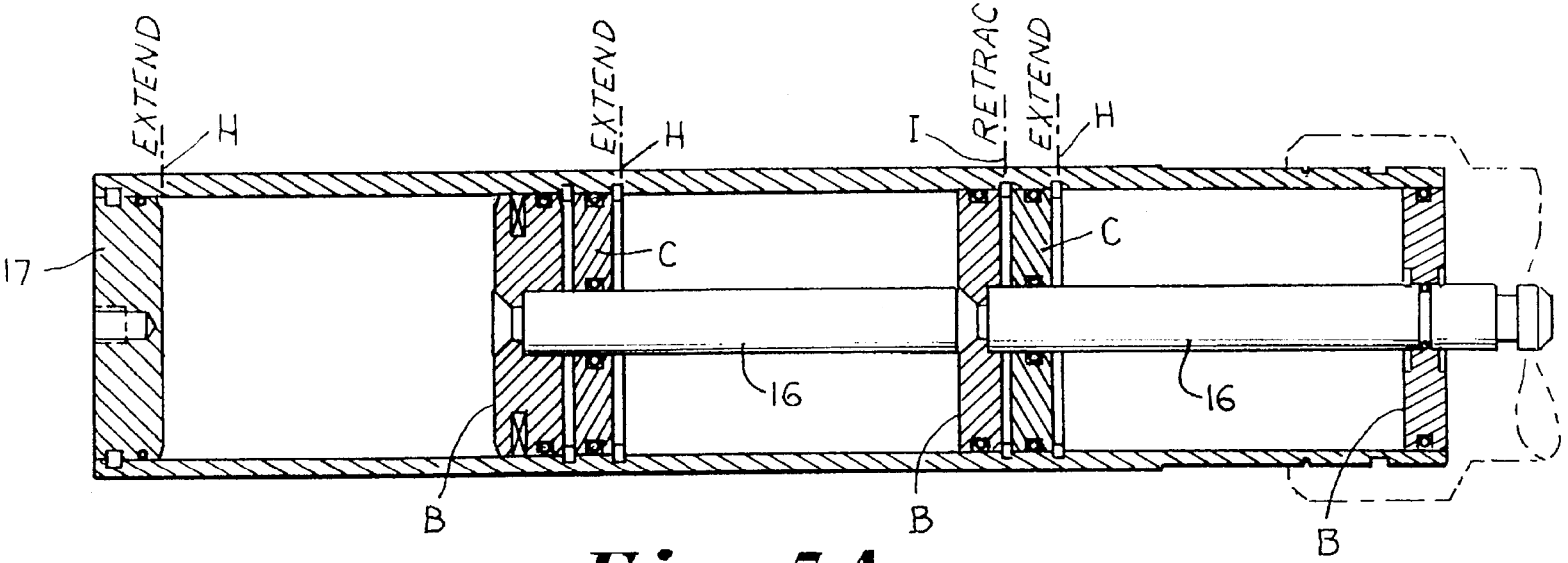
Fig. 5-A.

Fig. 8.
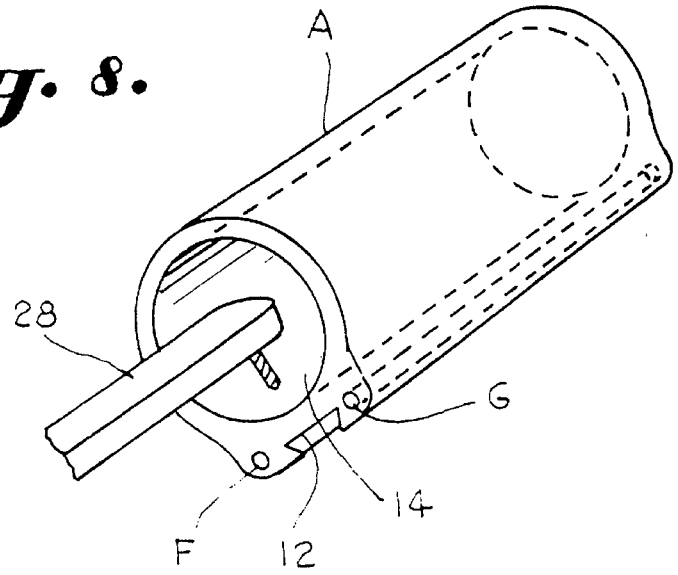
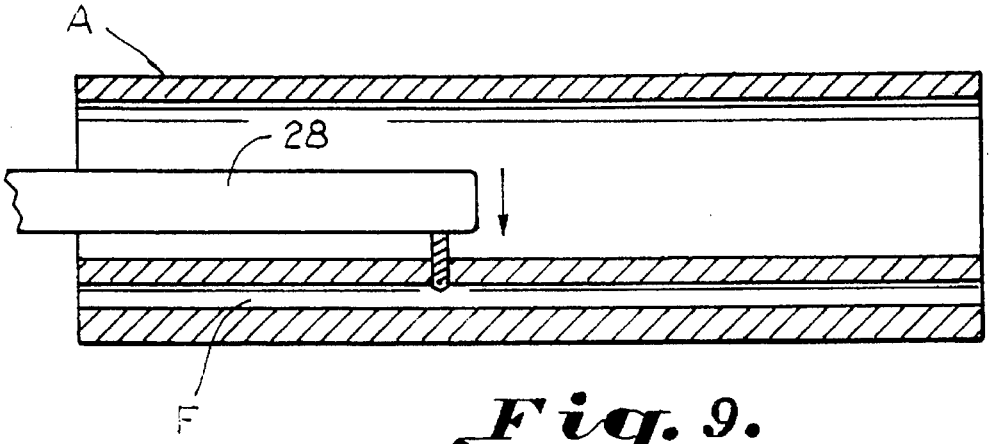
Fig. 9.
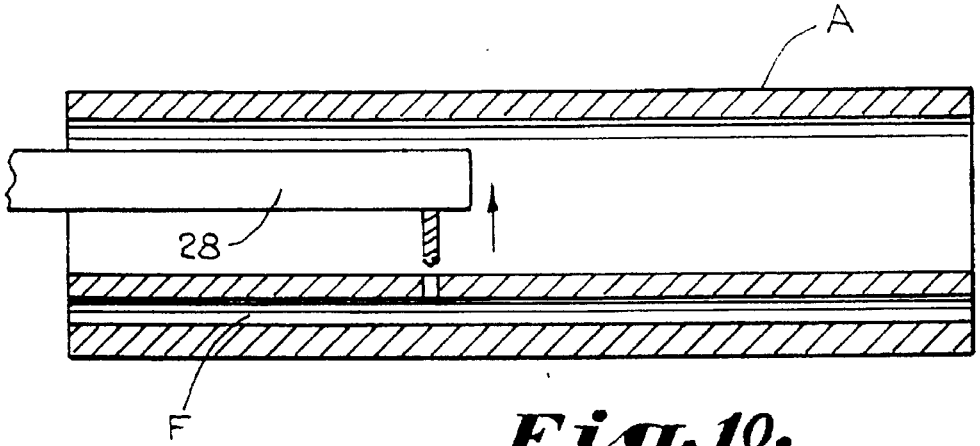
Fig. 10.

CYLINDER AND PISTON ASSEMBLY AND METHOD OF PORTING

BACKGROUND OF THE INVENTION

This invention relates to improved cylinder porting which is especially useful in multi-piston assemblies, and to an add-on cylinder and piston assembly.

Multi piston assemblies have been utilized, as for example, in fluid actuated hand tools such as shown in U.S. Pat. No. 3,323,346. Such devices have been limited in their operation due to the necessity for porting the multi-piston arrangement by utilizing a port in an end cap together with axial porting in a series of piston rods. In addition, in order to retract the multi-piston arrangement, it has been necessary to utilize either a spring or outside tubing for supplying fluid under pressure to a remote piston. Since such multi-piston devices must be ported through the piston rod, it has been necessary that the piston rod be inordinately large to accommodate the longitudinal porting passageways. Thus, the piston area for engagement by the pressurized fluid is limited by the size of the piston rod so that the total force exerted by the assembly is likewise limited. Moreover, porting through the piston rods necessitates an expensive manufacturing process requiring complicated molds or machining operations. The position of a fluid supply bore in one of the end caps limits the mode of actuation of the fluid operated assembly.

Because such inlet ports in end caps are operated by transverse valve operators, the use of elongated pivoted handles extending at right angles thereto and in alignment with the cylinders have been necessitated. Such hand held multi-piston assemblies are often used to power crimping tools carried by the cylinders remote from the inlets and because such tools are operated with great force by the multi-piston arrangements, inadvertent actuation thereof may be hazardous to the operator and others nearby. This hazard is increased by the necessity for utilizing a pivoted handle exposed along the outside of the cylinder. Firing of the multi-piston arrangement through actuation of the pivoted handle may occur inadvertently or as a result of dropping of the tool by an operator.

Since porting arrangements utilized heretofore require the valve and end port to be carried at the end cap opposite the power operated tool, it has never been known or thought to be desirable to provide an axial add-on component to increase the number of serially arranged pistons where it is desirable to increase the force which may be applied by such an assembly. While the apparatus illustrated herein is particularly related to using of the apparatus and method with a multi-piston fluid operated tool, it is to be understood that such assemblies and method are useful for any other applications where extraordinary force is required to be generated in a fluid operated apparatus.

Moreover, porting as has been provided utilizing bores in the cylinder side walls has required external right angled drilling in order to communicate with the inside of the cylinder. This requires the use of plugs to block off the longitudinal ports from the outside of the cylinder. Such plugging is expensive and often unsatisfactory due to leakage.

SUMMARY OF THE INVENTION

Accordingly, it is a important object of this invention to provide an improved fluid actuated hand tool wherein porting is carried out through circumferentially spaced axial tunnel ports carried in the cylinder housing and wherein a series of transverse inlet ports are provided from one of the tunnel ports while an outlet port is connected to the other of the tunnel ports.

Another important object of the invention is the provision of a cylinder housing extruded from suitable material such as aluminum wherein longitudinal circumferentially spaced longitudinal tunnel ports are provided for accommodating transverse fluid connections for operating a piston assembly.

Another object of the invention is the provision of a cylinder and piston assembly and an add-on auxiliary unit therefor carrying at least one additional piston assembly which may be conveniently attached at an end of the cylinder and piston assembly remote from a power tool or other apparatus carried at the opposite end of the assembly.

Another important object of the invention is to provide an economical and simplified cylinder and multi-piston assembly wherein porting is carried out utilizing axially disposed circumferentially spaced tunnel ports wherein at least one of the tunnel ports extends longitudinally of the cylinder and within the cylinder side wall.

Another important object of the invention is the provision of a novel switching arrangement for actuating the multi-piston assembly wherein a switch is recessed between longitudinal tunnel lugs in the cylinder so as to prevent inadvertent contact of the switch while being held or brought into contact with another surface or as when the apparatus is dropped by the operator.

Another important object of the invention is found in the utilization of the recess between spaced tunnel lugs provided in the cylinder housing to accommodate porting therein wherein switches may be adjustably positioned in recessed configuration so as to actuate the apparatus responsive to internal positioning of the pistons and associated parts.

Another important advantage of the invention is the provision of extruded cylinder housings with longitudinal ports therein. Such extrusions may be cut to desired lengths, and internal porting is best completed by boring from the inside with a right angled drill to avoid the necessity of plugging as when transverse ports are bored from the outside. Such cylinders are especially adaptable to the use of add-on auxiliary units because the longitudinal ports may be easily aligned with convenient securement when joining the cylindrical sections.

Through the various porting applications described herein, a necessity of providing ports in the end caps and through the side walls at right angles is avoided so that any of a variety of economical and advantageous arrangements may be selected.

While the invention hereof is described largely in terms of multi-piston arrangements, it is to be understood that the use of the circumferentially spaced longitudinal porting tunnels may be advantageously employed in a wide range of applications.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a perspective view illustrating a multi-piston cylinder assembly having porting carried in spaced longitudinal tunnel lugs mounting a Hall effect switch, together with an add-on unit formed from an extrusion constructed in accordance with the invention;

FIG. 2 is a transverse sectional elevation taken on the line 2—2 in FIG. 1, a transverse retraction port;

FIG. 3 is a transverse sectional elevation taken on the line 3—3 in FIG. 1 further illustrating the porting wherein a transverse port is utilized to connect a longitudinal inlet port in relation to an interior of the cylinder constructed in accordance with the invention;

FIG. 5 is a longitudinal sectional elevation taken on the line 5—5 in FIG. 1 further illustrating a multi-piston assembly;

FIG. 5-A is a longitudinal sectional elevation similar to FIG. 5 showing the pistons in extended position, with a schematic illustration of the positioning of the transverse ports, utilizing the total force afforded by the series of pistons together with actuation of a tool carried on one end of the cylinder remote from an end cap;

FIG. 8 is a perspective view further illustrating the method of porting wherein longitudinal tunnel ports are supplied with transverse porting connections in relation to the multi-piston assemblies utilizing a right angle drill for supplying the transverse porting;

FIG. 9 is a longitudinal sectional view illustrating a first step in the transverse porting of an extrusion containing longitudinal ports according to the invention utilizing a right angle drill;

FIG. 10 is a sectional elevation similar to that of FIG. 9 wherein a transverse port has been provided and the right angle drill is being retrieved from the cylindrical bore;

DESCRIPTION OF A PREFERRED EMBODIMENT

Figure 4:
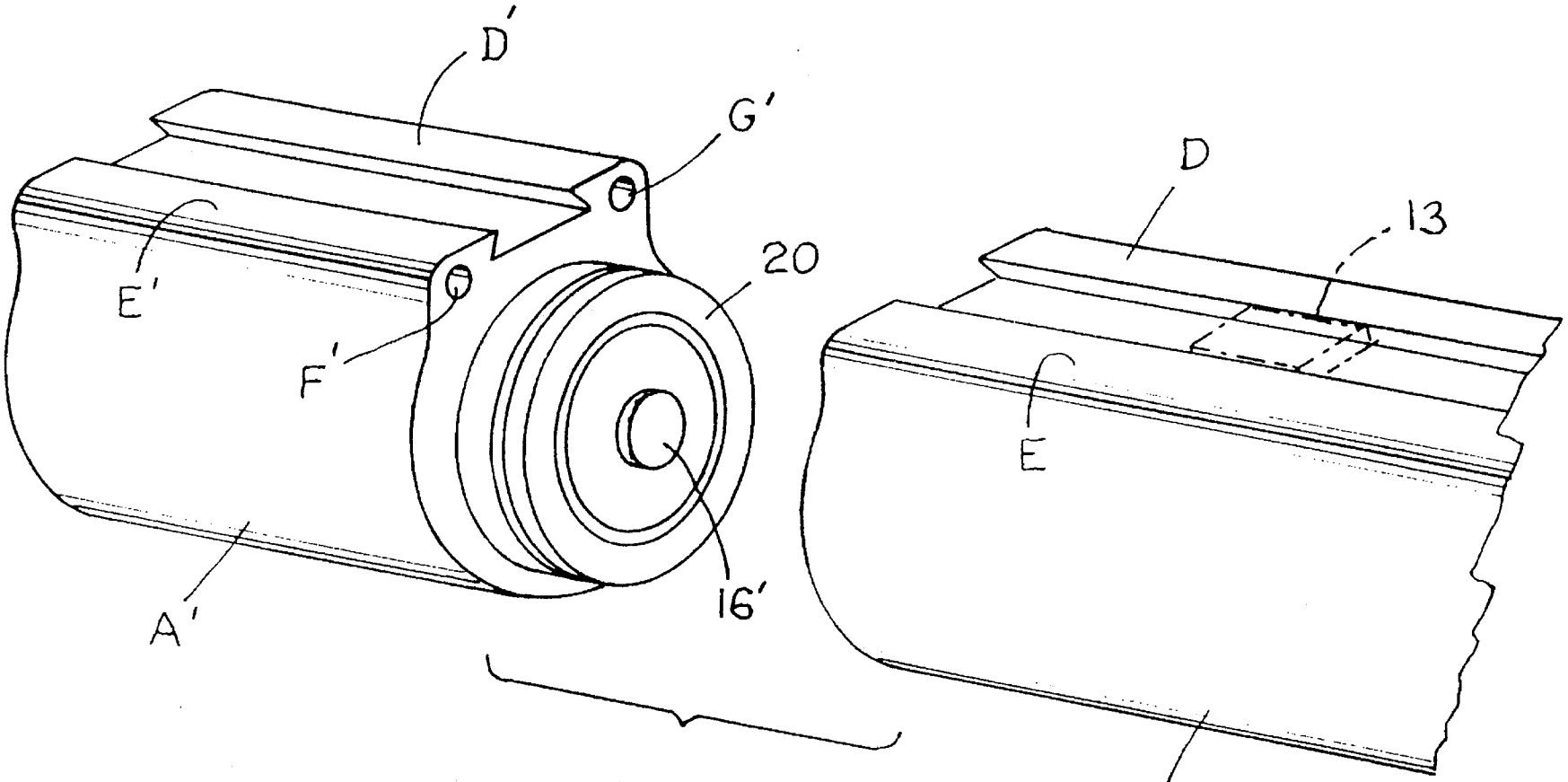
FIG. 4 is a perspective view illustrating an add-on unit constructed in accordance with the present invention and the method and apparatus for attaching the add-on unit in fixed relation at the free end of the cylinder further illustrating the apparatus of FIG. 1.

The drawings illustrate a cylinder and piston assembly including an elongated housing having a cylindrical wall. A series of spaced pistons are carried in axial alignment within the cylindrical housing A. Intermediate imperforate cap members C are also carried within the cylindrical wall in axial alignment between the spaced pistons B. A piston rod is carried in axial alignment by a piston on one end and by a respective intermediate cap member on the other end. An internally mounted end cap is carried at one end of the cylindrical wall. A pair of circumferentially spaced axial tunnel lugs D and E integral with the housing and having longitudinally aligned tunnel ports are carried in the elongated cylindrical wall in respective tunnel lugs opening on one end of the housing. The tunnel ports are closed on opposite ends. A series of transverse fluid inlet ports F are each connected to one of the tunnel ports in tunnel lug D which acts as an inlet tunnel port and with a respective internal cylindrical portion defined by an internal cylindrical wall behind each of the pistons. A transverse fluid port H is connected to the other of the tunnel port in tunnel lug E and acts as a retraction port. A pressure operated switch J for opening the inlet tunnel port to a source of pressurized fluid is positioned between the tunnel lugs and is protected thereby against inadvertent actuation.

The cylindrical wall A is provided preferably in the form of an aluminum extrusion. The cylinder housing A accommodates the multi-piston assembly hereof as well as longitudinal circumferentially spaced tunnel ports provided in longitudinal circumferentially spaced tunnel lugs D and E respectively. The lugs D and E are each defined by a substantially vertical outside wall 10*a* and 11*a* respectively. The lugs have flat upper surfaces 10*b* and 11*b* with downwardly extending diverging side walls 10*c* and 11*c*. The walls 10*c* and 11*c* together with a flat base portion 12 therebetween define a trackway for accommodating a Hall effect switch schematically illustrated at 13. Such an arrangement is described in U.S. Pat. No. 5,290,981, the disclosure of which is incorporated herein, for providing a convenient means for sensing the position of internal components of the multi-piston assembly.

A series of intermediate imperforate cap members C are carried in an internal cylindrical wall 14 in axial alignment between respective spaced pistons B and an internally mounted end cap 17 (FIG. 5). A suitable power operated tool is illustrated schematically in broken lines as at 15 at an end of the cylinder A opposite the internally mounted end cap. A plurality of piston rods 16 are best illustrated in FIGS. 5 and 5-A as being carried in axial alignment by the pistons on one end and by a respective intermediate cap member C on the other end. The internally mounted end cap 17 carried at one end of the cylindrical housing A has been removed in FIGS. 1 and 7 for reception of an add-on unit as described below.

Figure 12:
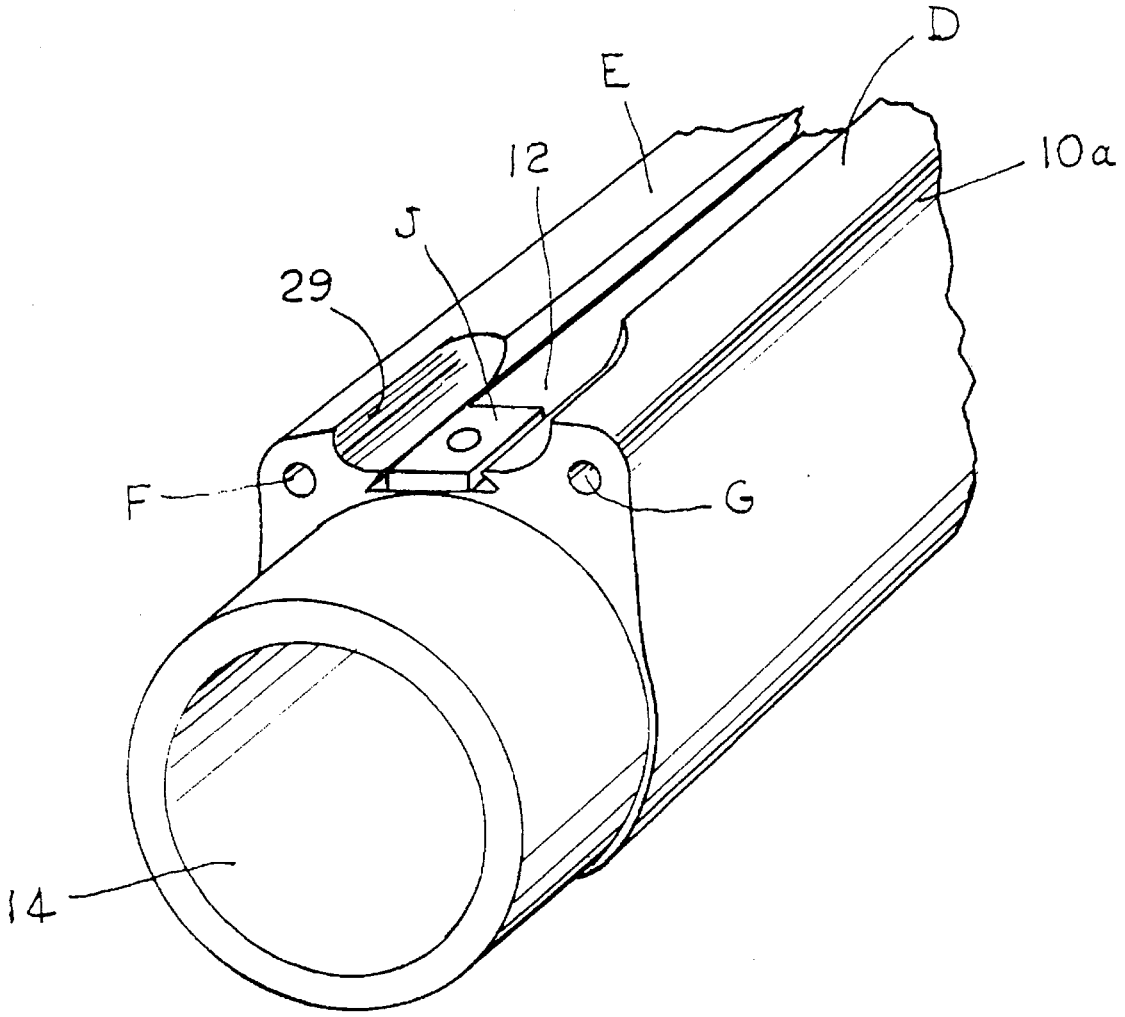
FIG. 12 is a perspective view further illustrating an arrangement for recessing a suitable switch such as a membrane switch between the porting lugs for manual operation to avoid inadvertent actuation as by dropping a hand held tool.

The tunnel ports are open on one end and closed on opposite ends adjacent the power operated tool 15. Suitable end plugs (not shown) are provided for closing opposite ends of the extruded tunnel ports F and G. A series of transverse fluid inlet ports H are each connected to the tunnel port in lug E which acts as an inlet tunnel port and with a respective internal cylindrical portion defined by the cylindrical wall 14 behind each of the pistons (FIGS. 1–3). A transverse fluid outlet port I is connected to the other of the tunnel port in lug D which may serve as an outlet port. A pressure operated switch J opens the inlet tunnel port to a source of pressurized fluid. The switch J is illustrated in FIGS. 1 and 12 as a membrane switch positioned between the lugs and protected thereby against inadvertent actuation.

Figure 6:
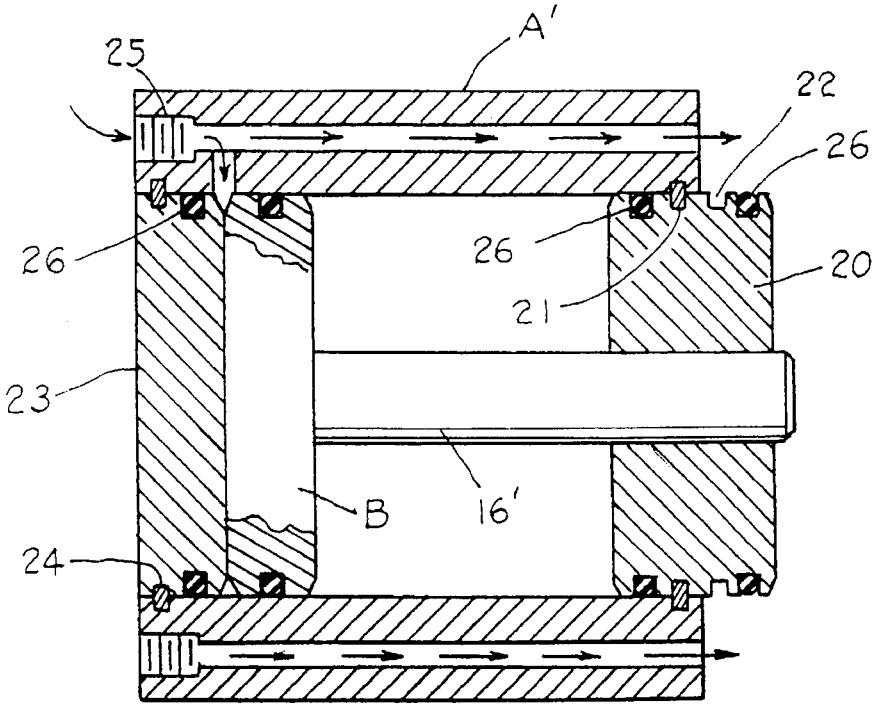
FIG. 6 is a longitudinal sectional elevation schematically illustrating an add-on unit for use in connection with a cylinder and multi-piston assembly constructed in accordance with the invention.
Figure 7:
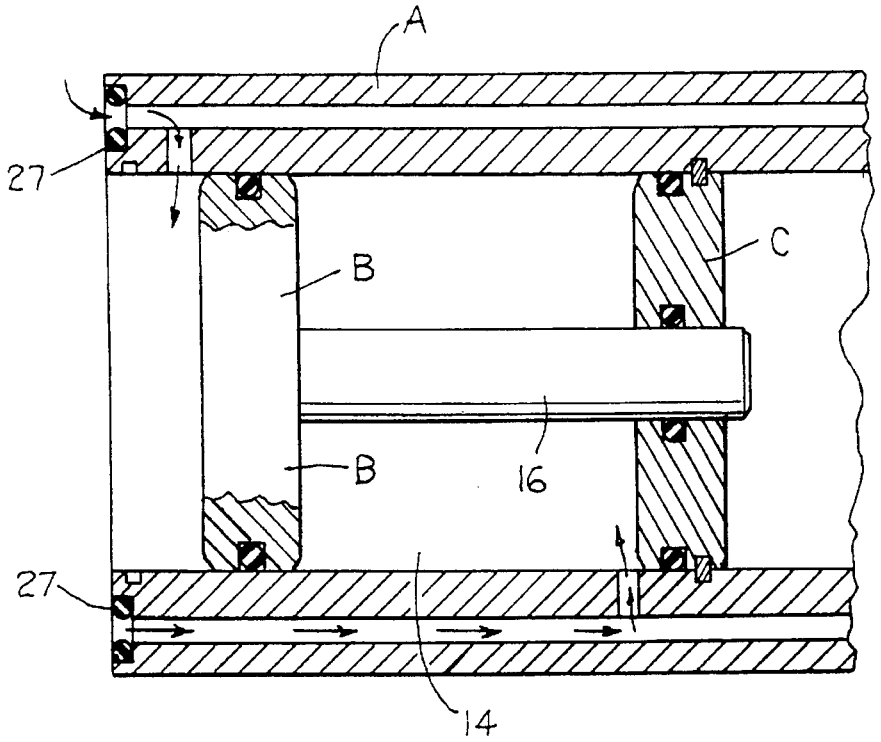
FIG. 7 is a longitudinal sectional elevation similar to FIG. 6 illustrating the parts in position for receiving an add-on piston assembly for accommodation within a first multi-piston assembly.

Referring more particularly to FIGS. 1, 4 and 6, it will be noted that a housing A' is provided for containing the add-on piston assemblies. The add-on component utilizes longitudinal ports F' and G' carried respectively in lugs E' and D'. A piston rod 16' is carried by the piston B'. A suitable arrangement for securement of an end cap 20 for the add-on component as best illustrated in FIGS. 6 and 7 schematically illustrates a method of securement wherein one side of the internally mounted end cap 20 is secured adjacent an abutting end of the housing A' as by a ring 21 whereas a ring 22 secures the other side of the end cap 20 to the housing A serving as an intermediate end cap thereof and in lieu of the end cap 17 which has been removed to accommodate the add-on unit A'. The accommodation of the rings 21 and 22 is further illustrated in U.S. Pat. No. 5,245,911, the disclosure of which is incorporated herein by reference. An opposed end of the add-on member has an end cap 23 which may be suitably secured as by a ring 24 on an inlet end of the housing A'. An inlet port is illustrated at 25 in the end of the cylinder of the add-on unit A'. Suitable O-rings 26 are provided for sealing the cap members 20, 21 and 23. Suitable O-rings 27 are provided for sealing the junctures between the respective longitudinal ports.

Alternate methods of attachment of the add-on units to the base units may include the use of screws or pins (not shown) in grooves in respective end cap portions 21 and 22.

FIGS. 8, 9 and 10 illustrate the steps in porting a cylinder having a longitudinal port formed therein as by extruding. The right angled 28 is being inserted within the inner cylindrical wall 14 in FIG. 8. Drilling is taking place in FIG. 9 while the drill is being withdrawn in FIG. 10.

Figure 11:
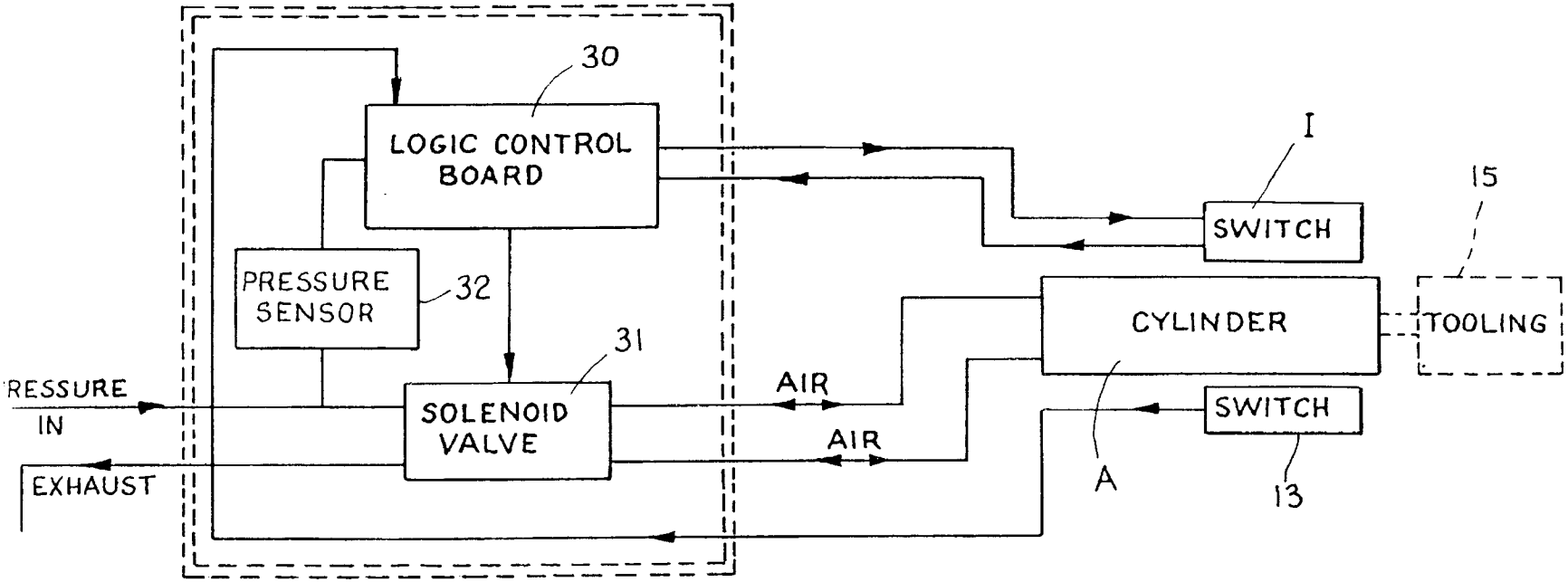
FIG. 11 is a block diagram illustrating the mode of operation of the various components utilized in carrying out the various operations associated with the multi-piston components.

Referring more particularly to FIG. 11, a programmable logic controller 30 includes a logic control board and is actuated by the switch J. The programmable logic controller 30 provides inlet air to the solenoid valve 31 provided the pressure sensor 32 permits such actuation. The pressure sensor assures a certain air pressure to the supply of the solenoid valve 31. The sensor 13 signals the programmable logic controller to retract the multi-piston assembly and the operating tool 15 operated thereby responsive to the pistons when in predetermined position. FIGS. 1 and 12 illustrate a relieved portion 29 wherein the upper portions of the lugs D and E are cut away to form a recess to accommodate the thumb of the user for initiating the cycle of operation through actuation of the switch J.

It is thus seen that a cylinder housing having longitudinally disposed inlet and outlet ports therein may be inexpensively provided and that transverse porting may be provided therein as required for operating internal components including a piston assembly. Because such ports may be provided entirely within the sides of the cylindrical housing A, it is unnecessary to utilize porting in end caps, thus reducing the cost of porting and affording more convenient connections for external operating apparatus independently of the end caps. Since the porting is carried out through the use of spaced longitudinal channels in the cylindrical walls which have transverse porting provided by internal right angle drilling, it is possible to manufacture inexpensively making possible the use of extrusions for supplying cylinders which are already largely ported when extruded. By utilizing the tunnel lugs, it is possible to recess switching arrangements to avoid inadvertently firing of the apparatus with consequent injury to operators of hand held tools and the like. Moreover, because of the porting arrangement, external to the interior cylinder wall, it is possible to conveniently supply add-on components with automatic porting alignment for a multi-piston operation.

While a preferred embodiment of the invention has been described using specific terms, such description is for illustrative purposes only, and it is to be understood that changes and variations may be made without departing from the spirit or scope of the following claims.

What is claimed is:

1. The method of porting a cylinder and piston assembly comprising the steps of:

forming a pair of circumferentially spaced longitudinally aligned tunnel ports in an elongated housing opening on one end of the housing; and drilling from the interior of said internal cylindrical wall a transverse fluid inlet port in said housing connected to one of said tunnel ports which acts as an inlet tunnel port and with a respective internal cylindrical portion defined by said cylindrical wall behind each of said pistons.

2. A cylinder and piston assembly comprising:

an elongated housing having an internal cylindrical wall;

a series of spaced pistons carried in axial alignment in said cylindrical wall;

an intermediate cap member in said internal cylindrical wall in axial alignment between said spaced pistons;

at least one piston rod carried in axial alignment by respective pistons on one end and by a respective intermediate cap member;

an end cap carried at one end of said cylindrical wall;

a pair of circumferentially spaced longitudinally aligned tunnel ports carried in said elongated housing opening on one end of said housing;

said tunnel ports each being open on said one end for communication with a source of pressurized fluid and closed on an opposite end;

a series of transverse fluid inlet ports each connected from said internal cylindrical wall to one of said tunnel ports without passage from said tunnel port to the exterior of the cylinder, said fluid inlet ports having been drilled in said cylindrical wall from the inside of said cylinder, said tunnel ports each acting as an inlet to a respective internal cylindrical portion defined by said cylindrical wall behind each of said pistons; and a transverse fluid outlet port connected to the other of said tunnel ports which acts as an outlet.

3. A hand held power tool operated by a cylinder and piston assembly comprising:

a hand held elongated housing having an internal cylindrical wall;

a series of spaced pistons carried in axial alignment in said cylindrical wall;

an intermediate cap member in said internal cylindrical wall in axial alignment between said spaced pistons;

at least one piston rod carried in axial alignment by respective pistons on one end and by a respective intermediate cap member;

an end cap carried at each end of said cylindrical wall;

a longitudinally aligned tunnel port bored through said elongated housing opening on one end of said housing;

said tunnel port being open on said one end for communication with a source of pressurized fluid and closed on opposite ends; and a series of transverse fluid inlet ports each connected to said tunnel port which allows communication only between said tunnel port and the inside of said cylinder, said transverse fluid inlet ports having been drilled from inside of said cylindrical wall outwardly to said tunnel port without passage to the exterior of said cylinder housing, said tunnel port acting as an inlet to a respective internal cylindrical portion defined by said cylindrical wall behind each of said pistons.

4. A hand held power tool operated by a cylinder and piston assembly comprising:

a hand held elongated housing having an internal cylindrical wall;

a series of spaced pistons carried in axial alignment in said cylindrical wall;

an intermediate cap member in said internal cylindrical wall in axial alignment between said spaced pistons;

at least one piston rod carried in axial alignment by respective pistons on one end and by a respective intermediate cap member;

an end cap carried at each end of said cylindrical wall;

a pair of circumferentially spaced axial lugs integral with said housing and having longitudinally aligned tunnel ports carried in said elongated housing in respective lugs opening on one end of said housing;

said tunnel ports being open on said one end and closed on opposite ends; and a series of transverse fluid inlet ports each connected to one of said tunnel ports which acts as an inlet tunnel port and with a respective internal cylindrical portion defined by said cylindrical wall behind each of said pistons;

a transverse fluid outlet port connected to the other of said tunnel ports which acts as an outlet tunnel port;

a valve carried by said elongated housing opening said inlet tunnel port to a supply of fluid under pressure thrusting said piston rod forwardly responsive to the action of all pistons; and a tool actuated by the action of said forward thrust.

5. A cylinder and piston assembly comprising:

an elongated housing having an internal cylindrical wall;

a series of spaced pistons carried in axial alignment in said cylindrical wall;

an intermediate cap member in said internal cylindrical wall in axial alignment between said spaced pistons;

at least one piston rod carried in axial alignment by respective pistons on one end and by a respective intermediate cap member;

an end cap carried at each end of said cylindrical wall;

a pair of circumferentially spaced axial lugs integral with said housing and having longitudinally aligned tunnel ports carried in said elongated housing in respective lugs opening on one end of said housing;

said tunnel ports being open on said one end and closed on opposite ends;

a series of transverse fluid inlet ports each connected to one of said tunnel port in said lug which acts as an inlet tunnel port and with a respective internal cylindrical portion defined by said cylindrical wall behind each of said pistons;

a transverse fluid outlet port connected to the other of said tunnel ports in the lug which acts as an outlet tunnel port; and a pressure operated switch for opening the inlet tunnel port to a source of pressurized fluid positioned between the lugs and protected thereby against inadvertent actuation.

6. A cylinder assembly comprising:

a housing having an internal cylindrical wall;

a piston carried in axial alignment in said cylindrical wall;

an internally mounted end cap carried on at least one end of said cylindrical wall;

a piston rod carried in axial alignment by said piston on one end and by a cap member;

a pair of circumferentially spaced longitudinally aligned tunnel ports carried in said housing opening on one end of said housing;

said tunnel ports each being open on said one end for communication with a source of pressurized fluid and closed on an opposite end;

a transverse fluid inlet port connected to one of said tunnel ports which avoids passage from said tunnel port to the exterior of said cylinder and having been drilled in said cylindrical wall from the inside of said cylinder, said tunnel port acting as an inlet with an internal cylindrical portion defined by said cylindrical wall behind said piston; and a transverse fluid outlet port connected to the other of said tunnel ports which acts as an outlet.

7. An add-on unit for connection to a cylinder and piston having an internally mounted end cap on one end thereof comprising:

an elongated housing having an internal cylindrical wall;

at least one piston carried in said cylindrical wall;

an intermediate cap member at one end of said internal cylindrical wall positionable in said cylinder and piston in lieu of said internally mounted end cap;

at least one piston rod carried in axial alignment by a piston on one end and by a complementary portion of said intermediate cap member;

a longitudinally aligned tunnel port carried in said elongated housing opening on one end of said housing for connection to said cylinder and piston assembly; and a transverse fluid inlet port drilled inside of said cylindrical wall from the inside of said cylinder communicating with said tunnel port acting as an inlet, said transverse fluid inlet port avoiding passage to the exterior of said cylinder;

whereby an assembly including a plurality of pistons increase the force applied by the cylinder and piston.

8. A cylinder housing for carrying a piston assembly in axial alignment therein comprising:

a pair of circumferentially spaced longitudinally aligned tunnel ports carried in said housing opening on one end of said housing;

said housing and tunnel ports having been formed as an extrusion which is thereafter cut to a predetermined length;

a transverse fluid inlet port connected to one of said tunnel ports which acts as an inlet and with an internal cylindrical portion defined by said cylindrical wall behind said piston; and a transverse fluid outlet port connected to the other of said tunnel ports which acts as an outlet.

9. The structure set forth in claim 8 including a pair of spaced longitudinal lugs carrying said tunnel ports.

10. The method of porting a cylinder and piston assembly comprising the steps of:

providing an elongated housing having an internal cylindrical wall;

positioning a series of spaced pistons carried in axial alignment in said cylindrical wall;

closing said internal cylindrical wall in axial alignment between said spaced pistons by a cap member;

supporting at least one piston rod in axial alignment on a respective piston on one end and by a cap member;

closing each end of said cylindrical wall;

forming a pair of circumferentially spaced longitudinally aligned tunnel ports in said elongated housing opening on one end of said housing;

closing said tunnel ports on opposite ends;

drilling a series of transverse fluid inlet ports in said housing each connected to one of said tunnel ports which acts as an inlet tunnel port and with a respective internal cylindrical portion defined by said cylindrical wall behind each of said pistons; and drilling a transverse fluid outlet port connected to the other of said tunnel ports which acts as an outlet tunnel port.

11. The method of porting a cylinder and piston assembly for operating a hand held power tool comprising the steps of:

providing a hand held elongated housing having an internal cylindrical wall;

positioning a series of spaced pistons carried in axial alignment in said cylindrical wall;

closing said internal cylindrical wall in axial alignment between said spaced pistons by a cap member;

supporting a piston rod carried in axial alignment by each of said pistons on one end and by a respective cap member adjacent thereto on the other end;

closing each end of said cylindrical wall;

drilling a series of transverse fluid inlet ports in said housing each connected to a respective internal cylindrical portion defined by said cylindrical wall behind each of said pistons;

drilling a transverse fluid outlet port in said housing; and mounting a power tool on said hand held housing actuated by the action of a forward thrust provided by the action of said fluid operated cylinders when supplied with pressurized fluid by said inlet ports.

* * * * *